US005746028A

United States Patent [19]

DiBenedetto

[11] Patent Number: 5,746,028

[45] Date of Patent: May 5, 1998

[54] MOVEABLE GRASS FIELD

[76] Inventor: John DiBenedetto, 11 Horsehill Rd., Brookville, N.Y. 11545

[21] Appl. No.: 883,564

[22] Filed: Jun. 26, 1997

[51] Int. Cl.[6] ..... E04B 3/10

[52] U.S. Cl. ..... 52/6; 52/409; 52/480; 472/92

[58] Field of Search ..... 52/6, 409, 408, 52/480; 472/92, 85

[56] References Cited

U.S. PATENT DOCUMENTS

| | | | |
|---|---|---|---|
| 2,837,984 | 6/1958 | Klotz | 472/92 X |
| 3,918,225 | 11/1975 | Fisher et al. . | |
| 4,023,506 | 5/1977 | Robey | 472/42 X |
| 4,026,076 | 5/1977 | Angletto | 52/6 |
| 4,044,179 | 8/1977 | Haas, Jr. | 472/92 X |
| 4,462,184 | 7/1984 | Cunningham | 472/92 X |
| 4,487,132 | 12/1984 | Fuchs et al. . | |
| 4,523,755 | 6/1985 | Turba | 472/92 |
| 4,633,625 | 1/1987 | Dieban et al. | 52/6 X |
| 4,674,249 | 6/1987 | Bennett, Jr. | 52/408 X |
| 5,103,600 | 4/1992 | Geiger et al. . | |
| 5,144,782 | 9/1992 | Paquette et al. | 52/408 |
| 5,254,039 | 10/1993 | Garcia | 472/92 |
| 5,365,704 | 11/1994 | Ray . | |
| 5,425,214 | 6/1995 | Truelove et al. . | |

FOREIGN PATENT DOCUMENTS

| | | | |
|---|---|---|---|
| 2492862 | 4/1982 | France | 472/92 |

*Primary Examiner*—Lanna Mai

[57] ABSTRACT

A new moveable grass field for providing natural turf playfields for enclosed sports stadiums. The inventive device includes a suprastructure base secured to and spanning a system of wheels for movement in and out of a sports stadium. A layer of cement is disposed above the suprastructure base. A layer of rocks are disposed above the layer of cement. A layer of gravel is disposed above the layer of rocks. A layer of sand is disposed above the layer of gravel. A layer of soil is disposed above the layer of sand. A layer of sod is disposed above the layer of soil.

5 Claims, 3 Drawing Sheets

MOVEABLE GRASS FIELD

BACKGROUND OF THE INVENTION

1. Field of the Invention

The present invention relates to floor assemblies and more particularly pertains to a new moveable grass field for providing natural turf playfields for enclosed sports stadiums.

2. Description of the Prior Art

The use of floor assemblies is known in the prior art. More specifically, floor assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art floor assemblies include U.S. Pat. No. 5,309,846 to Peterson; U.S. Pat. No. 5,365,704 to Ray; U.S. Pat. No. 5,425,214 to Truelove et al.; U.S. Pat. No. 5,103,600 to Geiger et al.; U.S. Pat. No. 3,918,225 to Fisher et al.; and U.S. Pat. No. 4,487,132 to Fuchs et al.

While these devices fulfill their respective, particular objectives and requirements, the aforementioned patents do not disclose a new moveable grass field. The inventive device includes a suprastructure base secured to and spanning a system of wheels for movement in and out of a sports stadium. A layer of cement is disposed above the suprastructure base. A layer of rocks are disposed above the layer of cement. A layer of gravel is disposed above the layer of rocks. A layer of sand is disposed above the layer of gravel. A layer of soil is disposed above the layer of sand. A layer of sod is disposed above the layer of soil.

In these respects, the moveable grass field according to the present invention substantially departs from the conventional concepts and designs of the prior art, and in so doing provides an apparatus primarily developed for the purpose of providing natural turf playfields for enclosed sports stadiums.

SUMMARY OF THE INVENTION

In view of the foregoing disadvantages inherent in the known types of floor assemblies now present in the prior art, the present invention provides a new moveable grass field construction wherein the same can be utilized for providing natural turf playfields for enclosed sports stadiums.

The general purpose of the present invention, which will be described subsequently in greater detail, is to provide a new moveable grass field apparatus and method which has many of the advantages of the floor assemblies mentioned heretofore and many novel features that result in a new moveable grass field which is not anticipated, rendered obvious, suggested, or even implied by any of the prior art floor assemblies, either alone or in any combination thereof.

To attain this, the present invention generally comprises a pair of elongated tracks positionable on opposing sides of a sports stadium and extending outwardly thereof. A plurality of wheel systems are adapted for rotational coupling with the elongated tracks. The wheel systems each include two pairs of opposing wheels coupling with opposing rails of the tracks. Each of the wheel systems include a frame disposed between the wheels and a base member secured to the frame and positioned above the wheels. A suprastructure base is secured to and spans the base members of the plurality of wheel systems. The suprastructure base comprises a planar frame of I-beams disposed on the base members of the plurality of wheel systems. Internally trussed floor panels are disposed above the planar frame. A supplemental base panel is disposed above the internally trussed floor panels. A layer of cement is disposed above the supplemental base panel of the suprastructure base. A layer of rocks are disposed above the layer of cement. A layer of gravel is disposed above the layer of rocks. A layer of sand is disposed above the layer of gravel. A layer of soil is disposed above the layer of sand. A layer of sod is disposed above the layer of soil.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new moveable grass field apparatus and method which has many of the advantages of the floor assemblies mentioned heretofore and many novel features that result in a new moveable grass field which is not anticipated, rendered obvious, suggested, or even implied by any of the prior art floor assemblies, either alone or in any combination thereof.

It is another object of the present invention to provide a new moveable grass field which may be easily and efficiently manufactured and marketed.

It is a further object of the present invention to provide a new moveable grass field which is of a durable and reliable construction.

An even further object of the present invention is to provide a new moveable grass field which is susceptible of a low cost of manufacture with regard to both materials and labor, and which accordingly is then susceptible of low prices of sale to the consuming public, thereby making such moveable grass field economically available to the buying public.

Still yet another object of the present invention is to provide a new moveable grass field which provides in the apparatuses and methods of the prior art some of the advantages thereof, while simultaneously overcoming some of the disadvantages normally associated therewith.

Still another object of the present invention is to provide a new moveable grass field for providing natural turf playfields for enclosed sports stadiums.

Yet another object of the present invention is to provide a new moveable grass field which includes a suprastructure base secured to and spanning a system of wheels for movement in and out of a sports stadium. A layer of cement is disposed above the suprastructure base. A layer of rocks are disposed above the layer of cement. A layer of gravel is disposed above the layer of rocks. A layer of sand is disposed above the layer of gravel. A layer of soil is disposed above the layer of sand. A layer of sod is disposed above the layer of soil.

Still yet another object of the present invention is to provide a new moveable grass field that allows for the natural turf to be cared for outdoors.

Even still another object of the present invention is to provide a new moveable grass field that allows for an entire playing field to be rolled into and out of a stadium structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
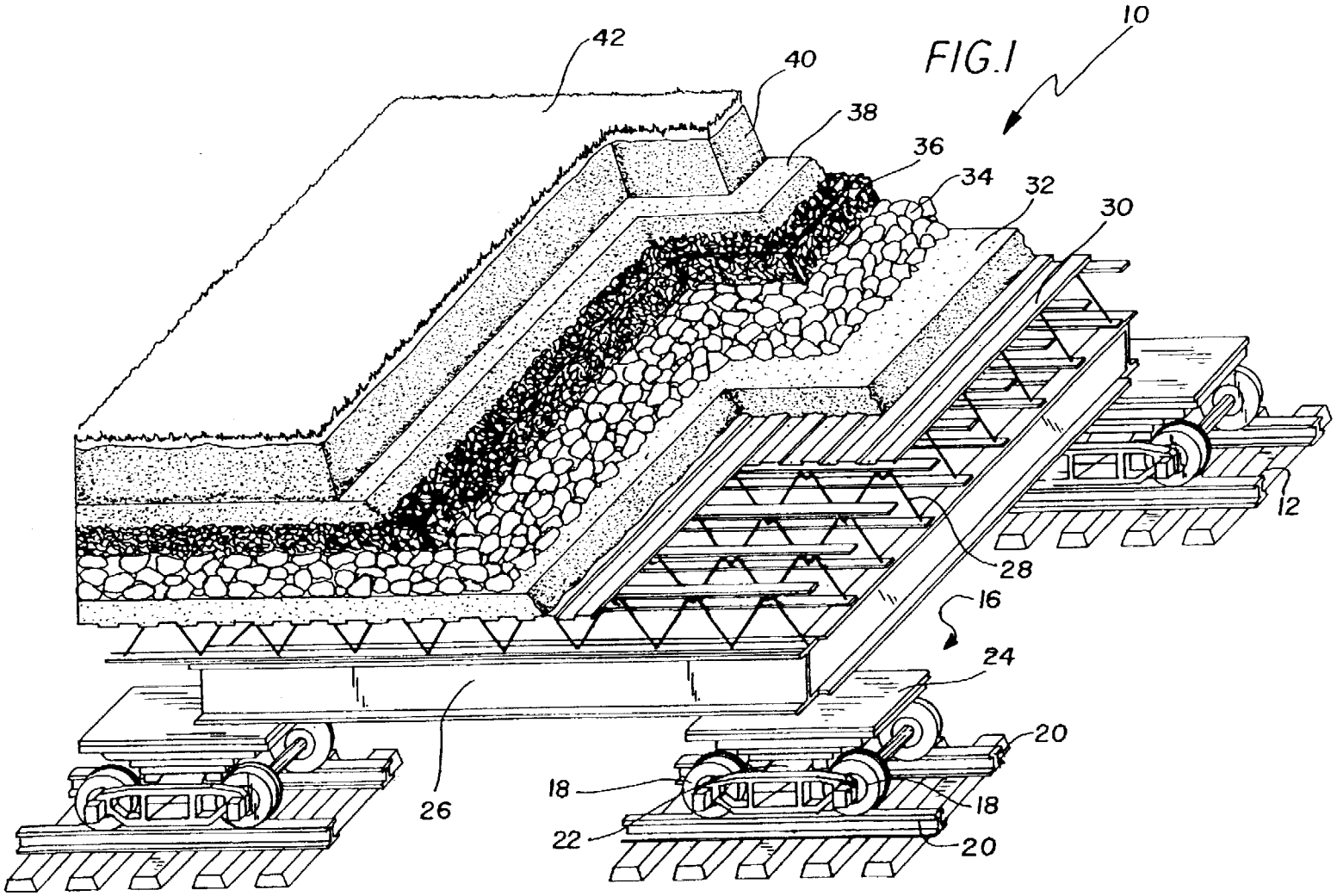
FIG. 1 is a perspective view of a new moveable grass field according to the present invention.
Figure 2:
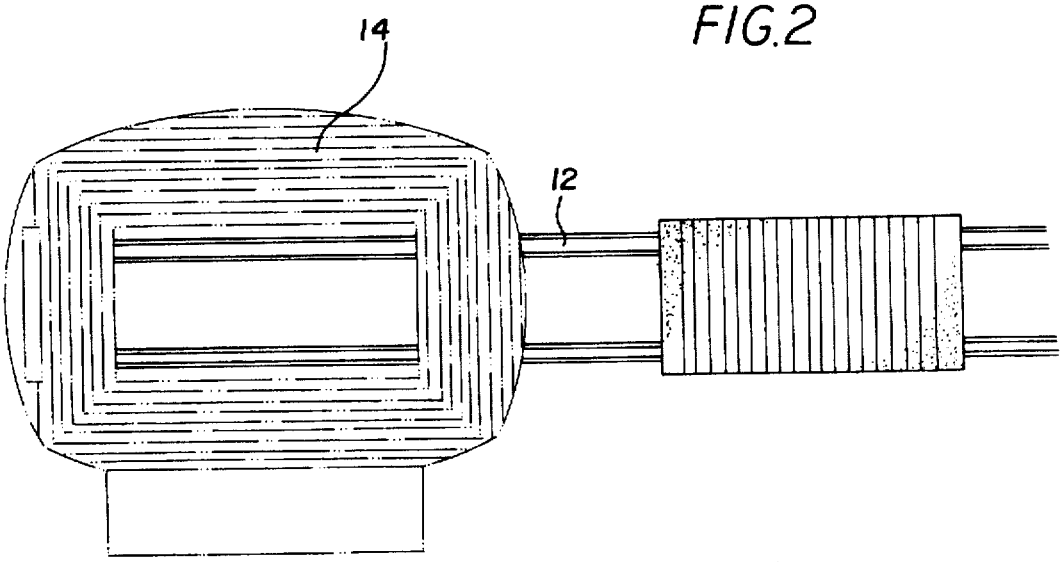
FIG. 2 is a top plan view of the present invention illustrated in use.
Figure 3:
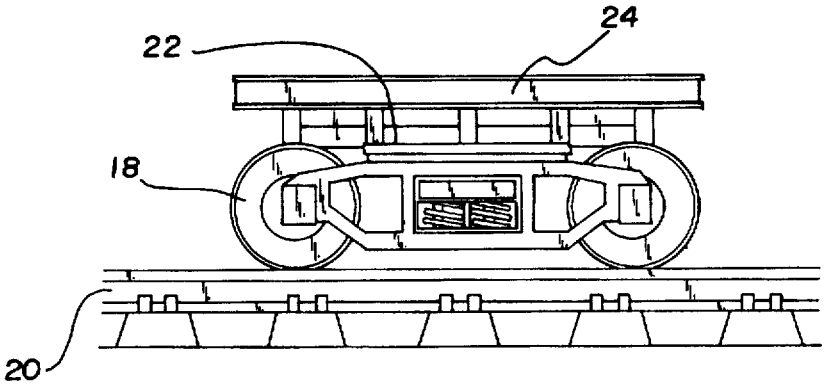
FIG. 3 is a side elevation view of the present invention illustrating the preferred mode of transportation.
Figure 4:
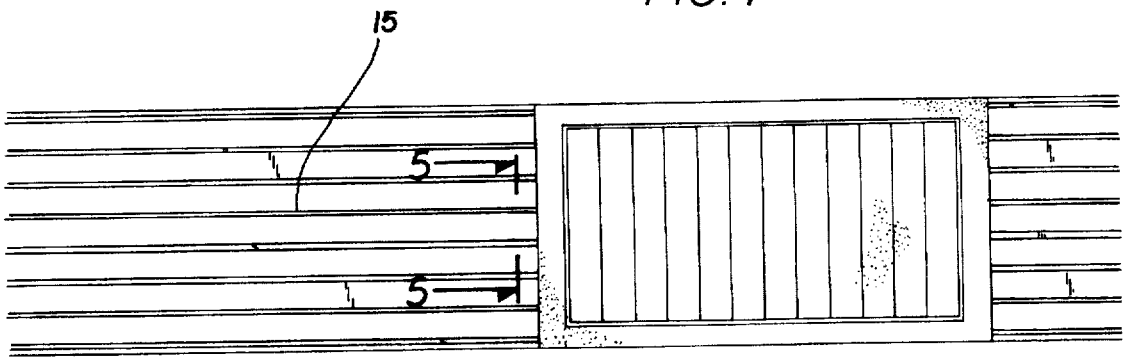
FIG. 4 is a top plan view of an alternate mode of transportation of the present invention.
Figure 5:
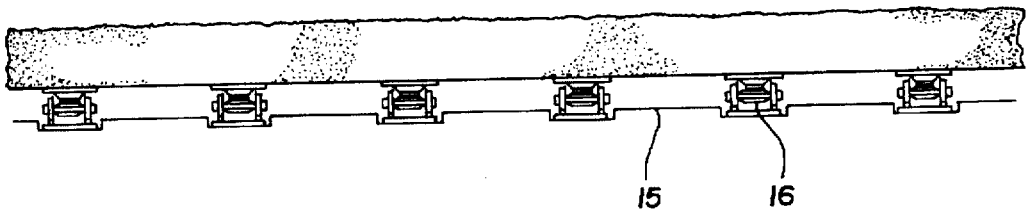
FIG. 5 is a view of the present invention taken along line 5—5 of FIG. 4.

With reference now to the drawings, and in particular to FIGS. 1 through 5 thereof, a new moveable grass field embodying the principles and concepts of the present invention and generally designated by the reference numeral 10 will be described.

As best illustrated in FIGS. 1 through 5, the moveable grass field 10 comprises a pair of elongated tracks 12 positionable on opposing sides of a sports stadium 14 and extending outwardly thereof. A series of tracks 15 could also be used with the device that span the surface of the sports stadium.

A plurality of wheel systems 16 are adapted for rotational coupling with the elongated tracks 12. The wheel systems 16 each include two pairs of opposing wheels 18 coupling with opposing rails 20 of the tracks 12. Each of the wheel systems 16 include a frame 22 disposed between the wheels 16 and a base member 24 secured to the frame 22 and positioned above the wheels 16. Additionally, the wheel systems 16 would come equipped with a braking system to preclude movement of the device 10. Motive power for the wheel systems may include electric or internal combustion powerplants. Such motive powers may either be integral with the wheel systems 16 or stand alone power units used with tow and pull cables. The wheel systems 16 employed would be essentially identical to those used in the railroad transportation industry.

A suprastructure base is secured to and spans the base members 24 of the plurality of wheel systems 16. The suprastructure base comprises a planar frame 26 of I-beams disposed on the base members 24 of the plurality of wheel systems 16. Internally trussed floor panels 28 are disposed above the planar frame 26. A supplemental base panel 30 is disposed above the internally trussed floor panels 28.

A playing field is included. The playing field is constructed of a number of layers. A layer of cement 32 is disposed above the supplemental base panel 30 of the suprastructure base. A layer of rocks 34 are disposed above the layer of cement 32. A layer of gravel 36 is disposed above the layer of rocks 34. A layer of sand 38 is disposed above the layer of gravel 38. A layer of soil 40 is disposed above the layer of sand 38. A layer of sod 42 is disposed above the layer of soil 40. Provisions for water drainage would be provided with the layers, while a gravel substrate and drainage pipes would be similarly be used in conjunction with the rail track foundations.

In use, the playing field is rolled into and out of a stadium as needed. Basically, the playing field will be rolled out of an enclosed stadium for providing sunlight to the playing field and regular maintenance. The playing field could also be rolled out of the stadium when not in use or to accommodate other events where the playing field would become damaged.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A moveable grass field for providing natural turf playfields for enclosed sports stadiums comprising, in combination:

a pair of elongated tracks positionable on opposing sides of a sports stadium and extending outwardly thereof;

a plurality of wheel systems (adapted) for rotation coupling with the elongated tracks, the wheel systems each including two pairs of opposing wheels coupling with opposing rails of the tracks, each of the wheel systems including a frame disposed between the wheels and a base member secured to the frame and positioned above the wheels;

a suprastructure base secured to and spanning the base members of the plurality of wheel systems, the suprastructure base comprising a planar frame of I-beams disposed on the base members of the plurality of wheel systems, internally trussed floor panels disposed above the planar frame, a supplemental base panel disposed above the internally trussed floor panels;

a layer of cement disposed above the supplemental base panel of the suprastructure base;

a layer of rocks disposed above the layer of cement;

a layer of gravel disposed above the layer of rocks;

a layer of sand disposed above the layer of gravel;

a layer of soil disposed above the layer of sand; and a layer of sod disposed above the layer of soil.

2. A moveable grass field comprising:

a suprastructure base secured to and spanning a system of wheels for movement in and out of a sports stadium;

a layer of cement disposed above the suprastructure base;

a layer of rocks disposed above the layer of cement;

a layer of gravel disposed above the layer of rocks;

a layer of sand disposed above the layer of gravel;

a layer of soil disposed above the layer of sand; and a layer of sod disposed above the layer of soil.

3. The moveable grass field as set forth in claim 2 and further including a track system adapted for coupling with the system of wheels.

4. The moveable grass field as set forth in claim 3 wherein the track system is comprised of a pair of elongated tracks disposed on opposing sides of the sports stadium with the system of wheels comprised of sets of wheels disposed on opposing sides of the suprastructure base.

5. The moveable grass field as set forth in claim 3 wherein the track system is comprised of a series of tracks spanning a recipient surface of the sports stadium with the system of wheels comprised of sets of wheels disposed in rows on a lower surface of the suprastructure base.

* * * * *